US012442544B2

(12) United States Patent
Wetzel et al.

(10) Patent No.: US 12,442,544 B2
(45) Date of Patent: Oct. 14, 2025

(54) CEILING MOUNTED EVAPORATOR BLOWER

(71) Applicant: Air Innovations, Inc., North Syracuse, NY (US)

(72) Inventors: Michael Wetzel, Skaneateles, NY (US); Curtis Smith, Syracuse, NY (US); Mark A. Ferguson, Syracuse, NY (US)

(73) Assignee: AIR INNOVATIONS, LLC, North Syracuse, NY (US)

( * ) Notice: Subject to any disclaimer, the term of this patent is extended or adjusted under 35 U.S.C. 154(b) by 248 days.

(21) Appl. No.: 18/087,984

(22) Filed: Dec. 23, 2022

(65) Prior Publication Data

US 2023/0130586 A1 Apr. 27, 2023

Related U.S. Application Data

(63) Continuation-in-part of application No. 17/035,469, filed on Sep. 28, 2020, now Pat. No. 11,536,467.

(60) Provisional application No. 62/906,974, filed on Sep. 27, 2019.

(51) Int. Cl.

| | |
|---|---|
| ***F24F 1/0047*** | (2019.01) |
| ***F24F 1/0014*** | (2019.01) |
| *F24F 13/22* | (2006.01) |

(52) U.S. Cl.

CPC ..... *F24F 1/0047* (2019.02); *F24F 1/0014* (2013.01); *F24F 2013/221* (2013.01)

(58) Field of Classification Search

CPC ..... F24F 1/0047; F24F 1/0014; F24F 1/0043; F24F 2013/221; F24F 13/20

See application file for complete search history.

(56) References Cited

U.S. PATENT DOCUMENTS

| | | | | |
|---|---|---|---|---|
| 3,143,952 A * | 8/1964 | Simons | F24F 9/00 454/190 |
| 4,458,502 A * | 7/1984 | Adachi | F24F 1/0057 62/263 |
| 4,660,389 A * | 4/1987 | Kido | F24F 1/0063 62/298 |

(Continued)

FOREIGN PATENT DOCUMENTS

| | | | |
|---|---|---|---|
| JP | 11264605 A * | 9/1999 | |
| WO | WO-2018083791 A1 * | 5/2018 | F24F 1/0047 |
| WO | WO-2018163285 A1 * | 9/2018 | F24F 1/0007 |

(Continued)

OTHER PUBLICATIONS

Mitsubishi MLZ Ceiling Cassette Review; Sep. 30, 2018 (Year: 2018).*

(Continued)

*Primary Examiner* — Emmanuel E Duke
(74) *Attorney, Agent, or Firm* — Barclay Damon LLP

(57) ABSTRACT

An air cooling system includes a chassis dimensioned to fit between a pair of joists, an evaporator positioned in the chassis and configured to cool air flowing through the chassis, and a diffuser assembly. The diffuser assembly includes one or more positioning guides that toollessly couple the diffuser assembly to the chassis. The diffuser assembly is structured to enable passage of the cool air from the chassis though the diffuser assembly and to a diffuser outlet, and to inhibit formation of condensation caused by the cool air exiting the outlet.

19 Claims, 20 Drawing Sheets

(56) References Cited

U.S. PATENT DOCUMENTS

| | | | | |
|---|---|---|---|---|
| 5,749,779 | A * | 5/1998 | Wilburn | B05B 16/60 454/67 |
| 6,257,013 | B1 * | 7/2001 | Murray | F24F 13/32 62/302 |

FOREIGN PATENT DOCUMENTS

| | | | | |
|---|---|---|---|---|
| WO | WO-2018167848 | A1 * | 9/2018 | F24F 1/0047 |
| WO | WO-2018179136 | A1 * | 10/2018 | F24F 1/0047 |
| WO | WO-2019038798 | A1 * | 2/2019 | F24F 1/0007 |

OTHER PUBLICATIONS

Mitsubishi 18,000 BTU MLZ EZ Fit 1-Way Ceiling Cassette System (Year: 2018).*

* cited by examiner

CEILING MOUNTED EVAPORATOR BLOWER

CROSS-REFERENCE TO RELATED APPLICATIONS

The present application is a continuation-in-part of U.S. patent application Ser. No. 17/035,469, filed on Sep. 28, 2020, which claims priority to U.S. Provisional App. No. 62/906,974, filed on Sep. 27, 2019. The entire contents of said applications are hereby incorporated by reference.

TECHNOLOGICAL FIELD

The following disclosure relates to heating and cooling systems and, more specifically, to an evaporator blower for an air conditioning system that can be mounted in a ceiling between the joists. The following disclosure is also directed to a cooling system that is easy to install in a tight space, such as a wine cabinet, easy to service, and configured to inhibit condensation formation on external surfaces.

BACKGROUND

Conventional ceiling mounted air conditioning units must be installed upon construction of the building or require significant retrofitting as the evaporator blower that is installed in the ceiling is wider than the distance between ceiling joists. Installation of a ceiling mounted unit in an existing home or building can be prohibitively expensive, if installation is even possible, as the existing ceiling joists must be removed or relocated while ensuring that all building codes remain satisfied. Moreover, the servicing of said units is difficult and requires significant downtime as well as using specialized tools in a tight space.

These are just some of the disadvantages associated with current ceiling mounted air conditioning (heating) units.

BRIEF SUMMARY OF THE INVENTION

The present invention is an air conditioning system that can be easily installed between a pair of joists in a building to install the air conditioning in the ceiling of a room. In an embodiment, the air conditioning system has a chassis dimensioned to fit between the pair of joists and defines an air flow pathway through which air may be cooled by an evaporator housed in the chassis. A mounting flange is pivotally coupled to the chassis and has an opening through which the chassis can pivot between a first position below the mounting flange, and thus the ceiling, to a second position above the flange, so that the chassis in above the ceiling and between the pair of joists. A diffuser is attached to the mounting flange and in fluid communication with the air flow pathway of the chassis. The mounting flange has a central opening through which the chassis can pivot between the first position and the second position. The chassis includes a supply air section, an evaporator, a fan assembly, and a return air section positioned in the air flow pathway. The diffuser includes a return air grille in communication with the return air section of the chassis and a supply air grille in communication with the supply air section of the chassis. The mounting flange includes a planar portion extending from the central opening. The planar portion of the mounting flange is dimensioned to be secured to the pair of joists. The chassis is pivotally coupled to the mounting flange by a first hinge positioned at a first end of the mounting flange. The chassis includes a series of brackets for coupling to the mounting flange when the chassis is in the second position. The diffuser is pivotally coupled to the mounting flange by a second hinge positioned at the first end of the mounting flange for movement between an open position and a closed position. The diffuser includes at least one locking tab positioned at an opposite end from the second hinge for coupling to the mounting flange when the diffuser is in the closed position. The central opening of the mounting flange is rectangular. The mounting flange includes a series of walls extending from at least three sides of the central opening and perpendicularly to the planar portion. In an embodiment, at least the planar portion of the mounting flange includes a series of apertures positioned to allow the mounting flange to be coupled to the pair of joists that are a minimum of twelve inches apart from each other so that the air conditioning system can be installed in the standard joist construction scenario.

Another embodiment of an air cooling or air conditioning system includes a chassis dimensioned to fit between a pair of joists, an evaporator positioned in the chassis and structured to cool air flowing through the chassis, and a diffuser assembly. The diffuser assembly includes one or more positioning guides structured to toollessly couple the diffuser assembly to the chassis. The diffuser assembly is structured to enable passage of the cool air from the chassis though the diffuser assembly and to a diffuser outlet, and to inhibit formation of condensation caused by the cool air exiting the outlet.

In an embodiment, the diffuser assembly further includes a seal structured to abut a portion of the chassis when the diffuser assembly couples to the chassis in a toolless manner. In an embodiment, the diffuser assembly further includes at least one or more diverting elements that extend below the diffuser outlet and are positioned at an angle relative to a vertical axis. In an embodiment, a flange is structured to pivotally couple to the chassis so that the chassis can pivot between a first position below the mounting flange to a second position above the flange. In another embodiment, the mounting flange defines a central opening through which the chassis can pivot between the first position and the second position. In an embodiment, the chassis houses an supply air section, a evaporator, a fan assembly, and a return air section. In an embodiment, the diffuser assembly includes a return air grille in communication with the return air section of the chassis and a supply air grille in communication with the supply air section of the chassis. In a further embodiment, the flange includes a planar portion extending from the central opening and the planar portion of the flange is dimensioned to be secured to the pair of joists. In an embodiment, the flange includes a plurality of sides that extend from the planar portion. In another embodiment, the chassis includes one or more coupling elements configured to enable pivotally coupling the chassis to the flange. In an embodiment, the chassis includes at least one lock element structured to lock the chassis in place relative to the flange. In a further embodiment, the central opening of the mounting flange is rectangular. In an embodiment, the chassis and/or the flange may have a plurality of openings that are each dimensioned to accept a faster to aid in coupling the chassis and/or flange to the joist structures. In another embodiment, a blocking structure may be positioned at least partially around the chassis or the flange to aid in fitting the evaporator blower in a joist space that is greater than 12 inches wide.

BRIEF DESCRIPTION OF THE DRAWINGS

The present invention will be more fully understood and appreciated by reading the following Detailed Description in conjunction with the accompanying drawings, in which.

DETAILED DESCRIPTION

The following discussion relates to various embodiments of an air cooling or air conditioning system. It will be understood that the herein described versions are examples that embody certain inventive concepts as detailed herein. To that end, other variations and modifications will be readily apparent to those of sufficient skill. In addition, certain terms are used throughout this discussion in order to provide a suitable frame of reference with regard to the accompanying drawings. These terms such as "upper", "lower", "forward", "rearward", "interior", "exterior", "front", "back", "top", "bottom", "inner", "outer", "first", "second", and the like are not intended to limit these concepts, except where so specifically indicated. The terms "about" or "approximately" as used herein may refer to a range of 80%-125% of the claimed or disclosed value. With regard to the drawings, their purpose is to depict salient features of the air cooling or air conditioning system and are not specifically provided to scale.

Figure 1:
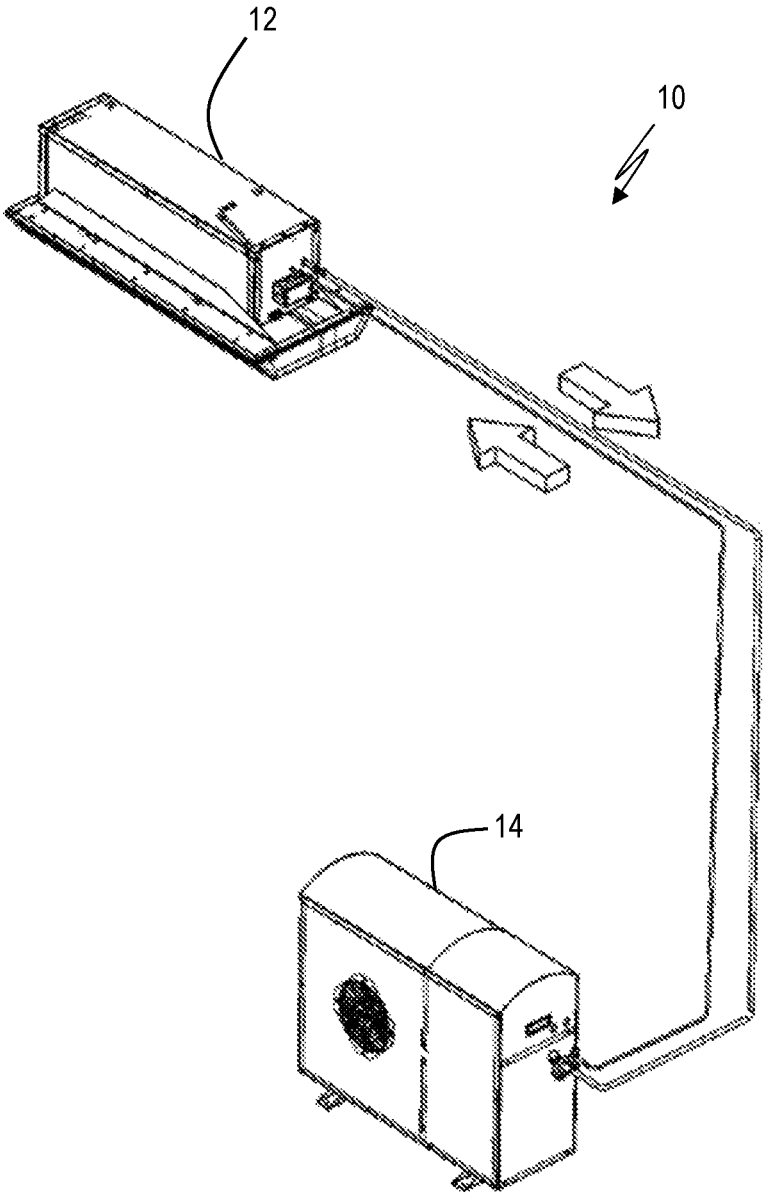
FIG. 1 is a schematic of an air conditioning system according to the present invention.
Figure 2:
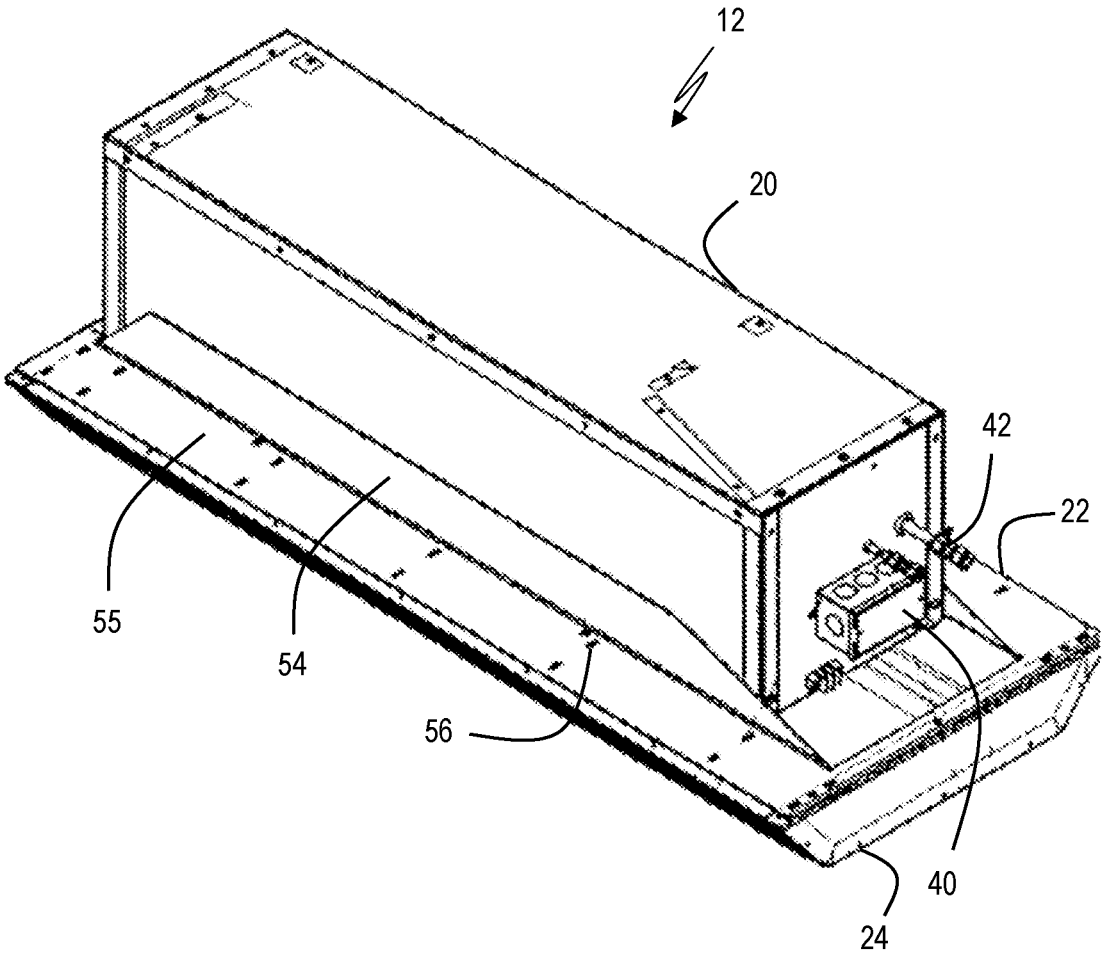
FIG. 2 is a perspective view of an evaporator blower according to the present invention.
Figure 3:
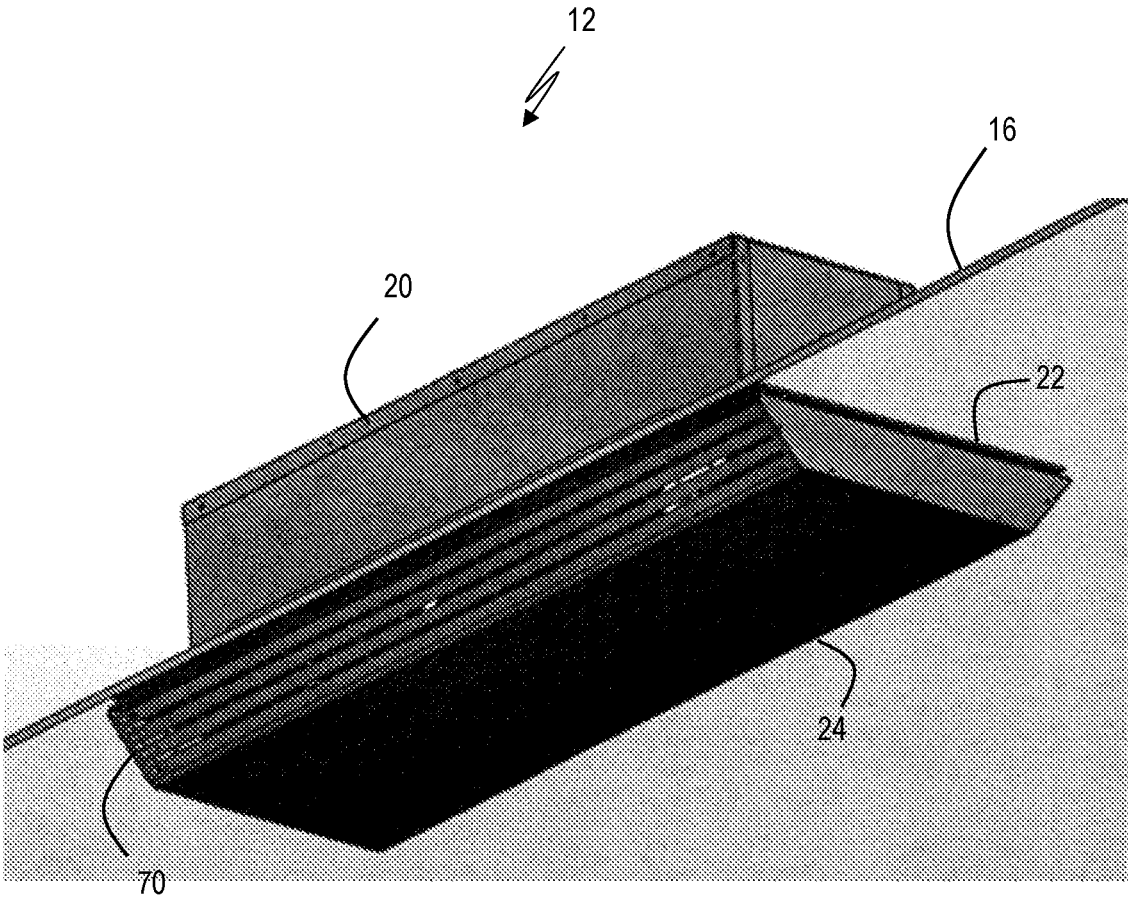
FIG. 3 is a perspective view of an evaporator blower according to the present invention installed in a ceiling.

Referring to the figures, wherein like numeral refer to like parts throughout, there is seen in FIG. 1 air conditioning system 10 having a ceiling mounted evaporator blower 12 and a condensing unit 14 positioned remotely, such as a location outdoors. Evaporator blower 12 is configured for mounting in a ceiling 16 between adjacent joists 18, such as ceiling joists or the floor joists of a next story, which are either 12 inches or 14 inches apart depending on building codes and building construction. Referring to FIGS. 2 and 3, evaporator blower 12 comprises a fan-coil chassis 20 that extends above ceiling 16 when installed, a mounting flange 22 that secures evaporator blower 12 to ceiling 16 by coupling to adjacent ceiling joists 18, and a diffuser 24 that is coupled to mounting flange 22 to extend below ceiling 16.

Figure 4:
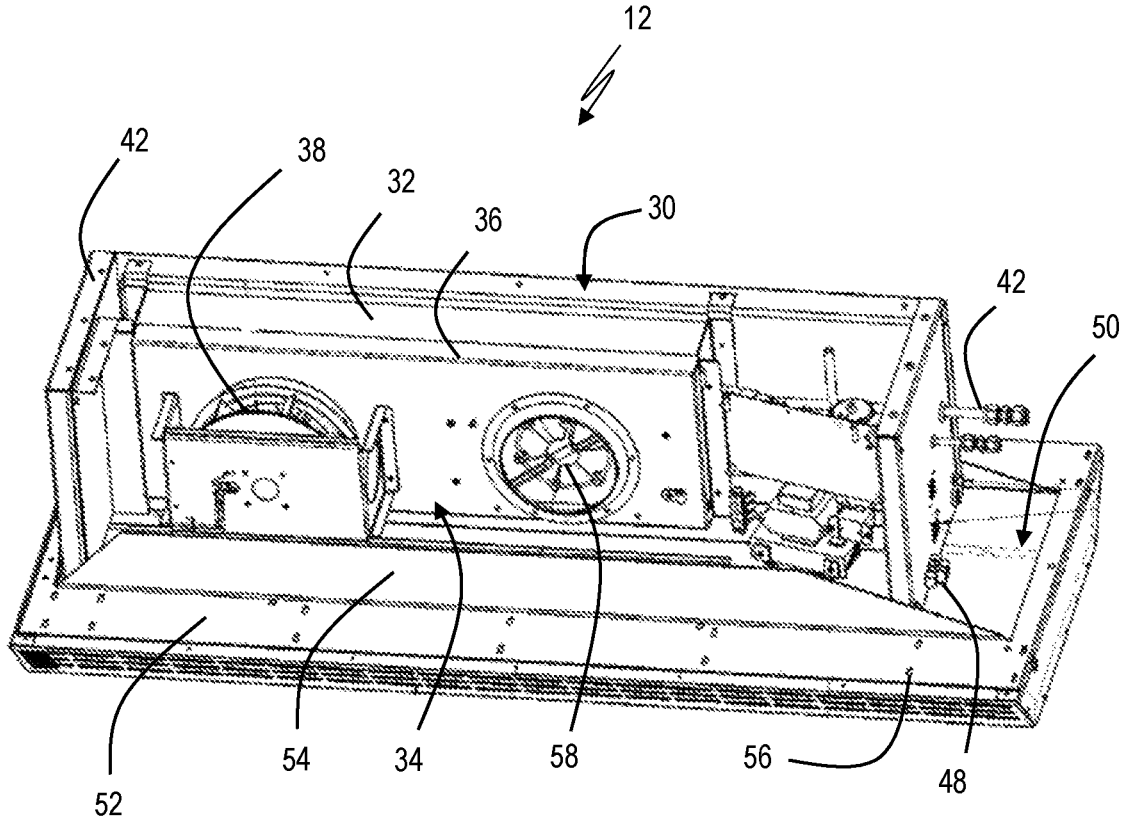
FIG. 4 is a perspective view of the inside of a chassis of an evaporator blower according to the present invention.
Figure 5:
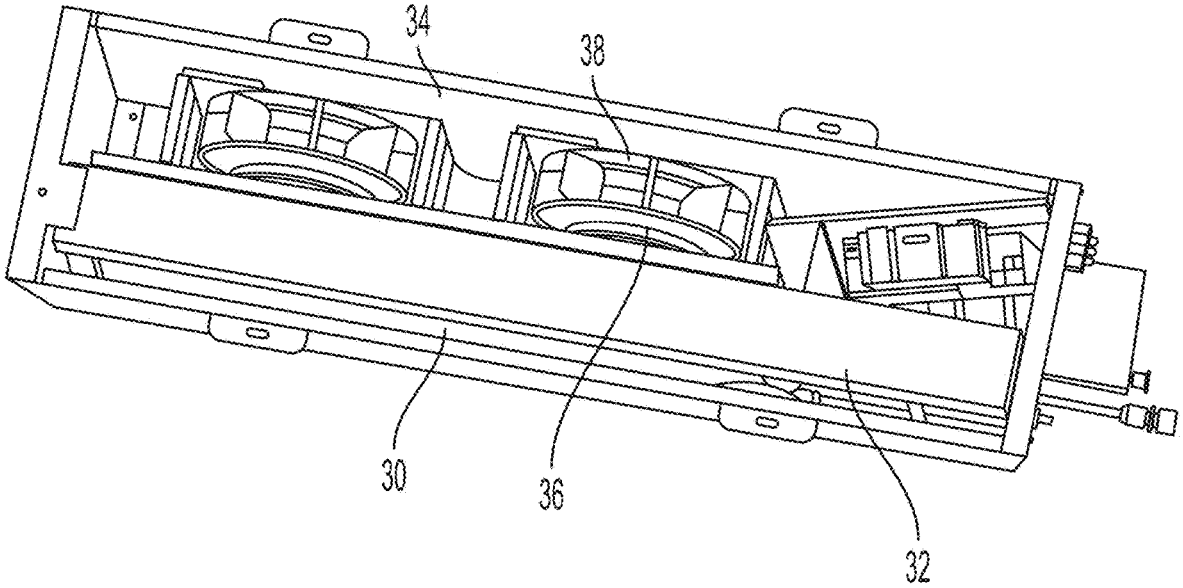
FIG. 5 is a perspective view of the inside of a chassis of an evaporator blower according to the present invention.

Referring to FIGS. 4 and 5, chassis 20 defines an airflow pathway having a return air inlet 30 that withdraws air from the room to be cooled and a supply air outlet 34 that returns cooled air back to the room. Chassis 20 includes an evaporator coil assembly 32 positioned transversely across airflow pathway between return air inlet 30 and supply air outlet 34 and vertically in the space between joists 18. A fan shroud 36 supporting one or more motorized impeller fans 38 is positioned against evaporator coil assembly 32. Fans 38 draw air into the airflow pathway via return air inlet 30 for cooling by evaporator coil 32 and then return the cooled air back to the room via supply side outlet 34, thereby providing air conditioning for the room. A heater 58 may optionally be mounted within fan shroud 36 and airflow pathway to provide warm air (second fan 38 removed in FIG. 4 for clarity).

Figure 6:
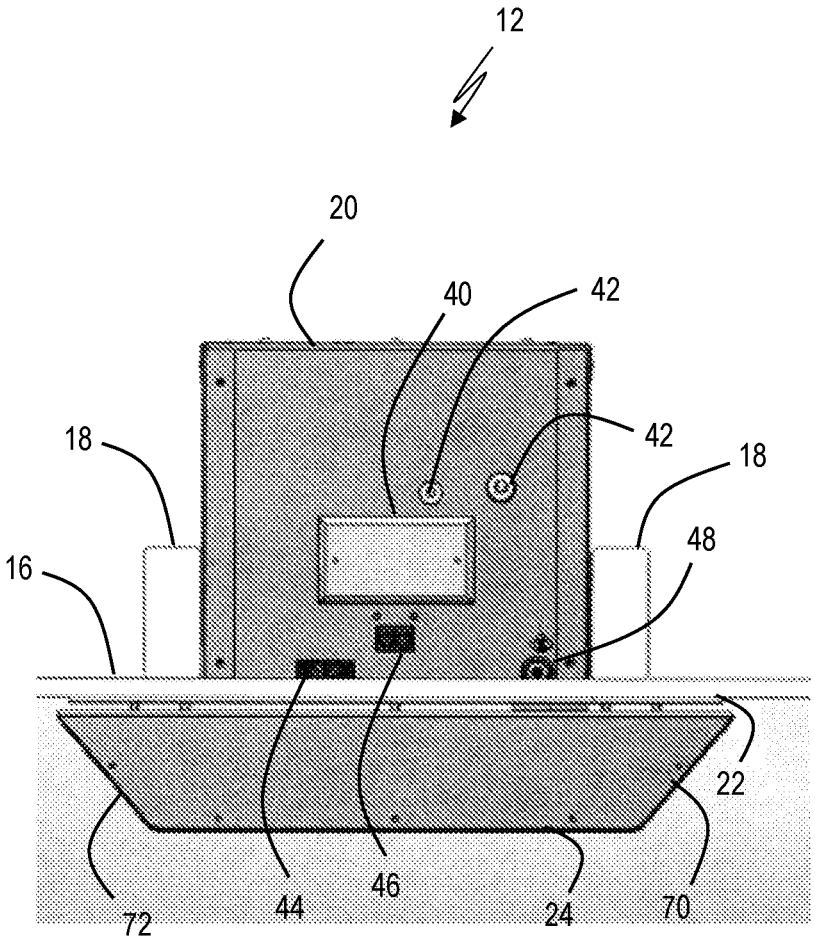
FIG. 6 is an end view of an evaporator blower according to the present invention installed in a ceiling.
Figure 7:
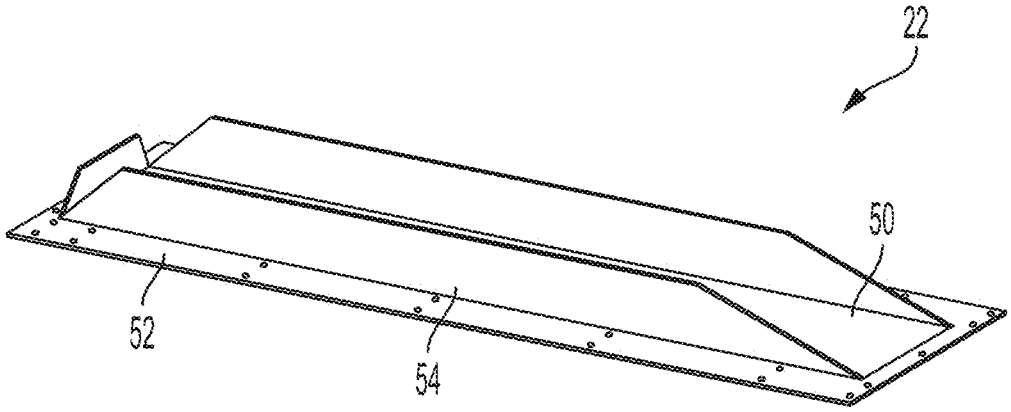
FIG. 7 is a perspective view of a mounting flange according to the present invention.

As seen in FIG. 6, chassis 20 further comprises a junction box 40 for coupling to the power supply of the building, refrigerant piping 42 (such as standard suction line and liquid line) for coupling to condensing unit 14, a 24-volt connection 44, a remote sensor cable connection 46, and a drain 48. Chassis 20 is dimensioned to fit vertically and be pivotally within a rectangular central opening 50 of mounting flange 22, and thus has a width that is less than 12 inches so that chassis 20 can fit between adjacent ceiling joists 18. Referring to FIG. 7, mounting flange 22 comprises a planar portion 52 extending horizontally outwardly from rectangular central opening 50. Three sides of central opening 50 include vertical walls 54 extending upwardly from the one of the short sides and both of the long sides of opening 50. Mounting flange 22 is dimensioned for attachment to standard joists (12 or 16 inch) and thus may include one or more sets of apertures 56 extending through planar portion 52 so that mounting flange 22 can be coupled to joists 18, such as via a series of wood screws positioned in apertures 56.

Figure 8:
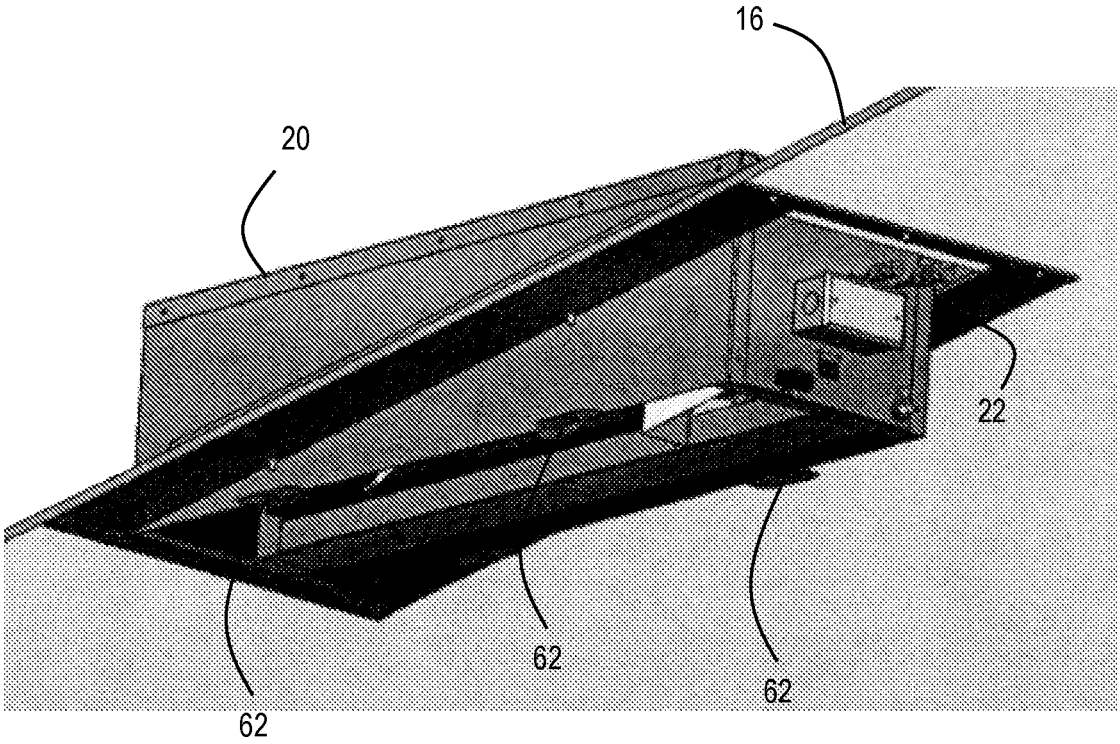
FIG. 8 is a perspective view of a chassis partially installed into a mounting flange according to the present invention.
Figure 9:
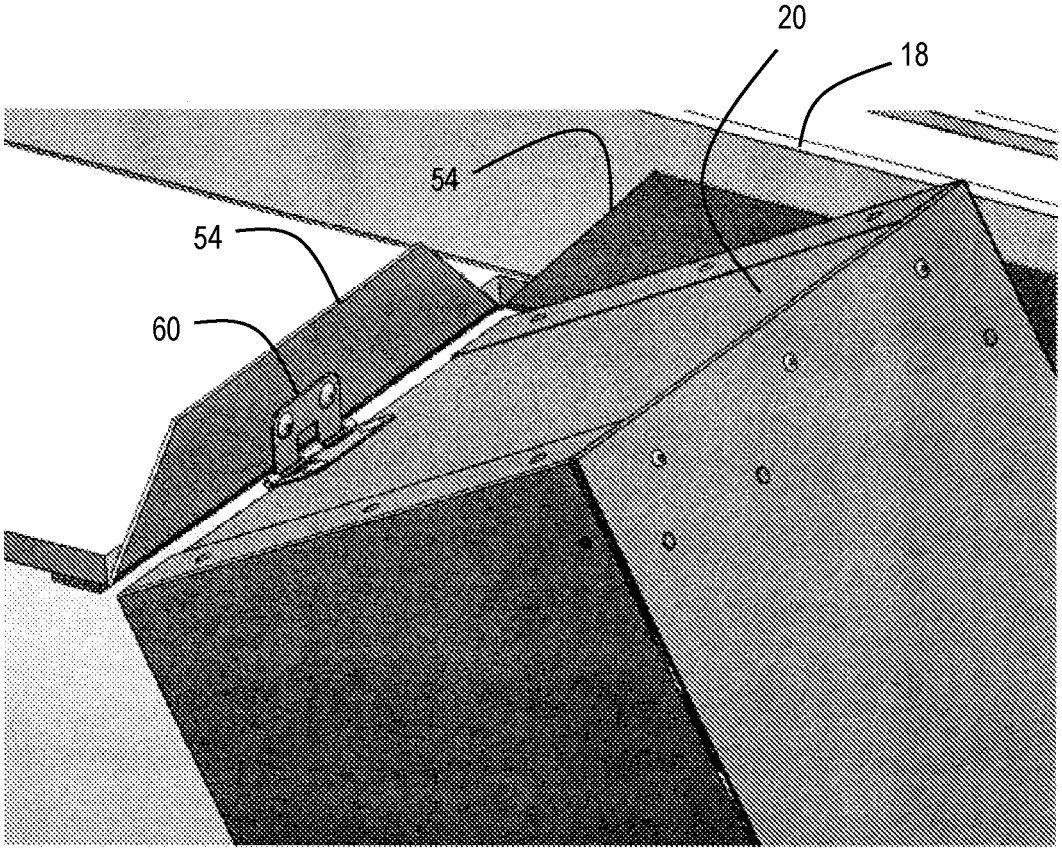
FIG. 9 is a perspective view of a chassis partially installed into a mounting flange according to the present invention.

Referring to FIGS. 8 and 9, chassis 20 is pivotally coupled to mounting flange 22 via a lift-off hinge 60 coupled to chassis 20 and mounting flange 22 along an intermediation portion of one of the short sides of rectangular opening 50. Hinge 60 allows chassis 20 to pivot between a first position, where chassis 20 extends downwardly below ceiling 16 and mounting flange 22, and a second position, where the bottom of chassis 20 is aligned horizontally with mounting flange 22 so that the chassis 20 extends above ceiling 16 between joists 18, as seen in FIG. 4. Chassis 20 may thus be easily installed by attaching chassis 20 to mounting flange 22 with lift-off hinge 60, and then swinging chassis 20 about hinge 60 into the second position. Mounting brackets 62 that extend horizontally from the sides of the lower edge of chassis 20 may be used to securely bolt chassis 20 to mounting flange 22 to retain chassis 20 in the second position. Conversely, chassis 20 may be unbolted and pivoted about hinge 60 from the second position back to the first position for each maintenance or repair without having to completely remove evaporator blower 12 from ceiling 16.

Figure 10:
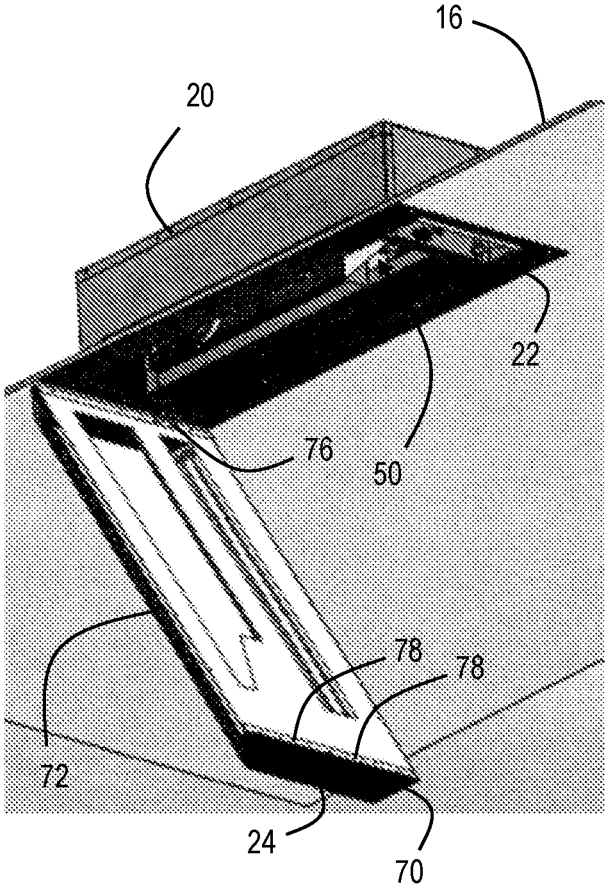
FIG. 10 is a perspective view of a grill assembly coupled to a mounting flange according to the present invention.

Referring to FIG. 10, diffuser 24 comprises a return air side grille 70 on one side and a supply air side grille 72 on an opposing side. Return air side grille 70 and supply air side grille 72 are aligned with and in-fluid communication with return air inlet 30 and supply air outlet 34 of chassis 20, respectively, when diffuser 24 is installed. Diffuser 24 is coupled to mounting flange 22 at one end via a lift-off hinge 76. Diffuser 24 may thus be easily coupled to mounting flange 22 by hinge 76, pivoted upwardly into engagement with mounting flange 22, and then secured in place with a pair of locking tabs 78 positioned at the opposing end of diffuser 24 from hinge 74 to complete assembly of evaporator blower 12. Diffuser 24 is preferably manufactured from anodized aluminum so that diffuser 24 can be painted to match ceiling or otherwise as desired.

Another embodiment of an air handling system 100 will now be discussed with reference to FIGS. 11-20. The air handling system 100 will be described with reference to an air cooling or air conditioning system 100, however one skill in the art would realize that many of inventive concepts described can also be used with systems that also heat air and/or control humidity. The air cooling system 100 as described may be used in installations previously described, however is particularly suited and configured for use in constricted spaces at least partially enclosed by glass, such as display cases, wine cabinets, or humidors. Several components of the air cooling system 100 are similar to other embodiments previously discussed and are not described in great detail.

Referring to FIGS. 11, 12, 14, 15 and 19, the air cooling system 100 similarly includes a evaporator blower 120 and a condensing unit 110 that is positioned remote from the evaporator blower 120. The evaporator blower includes a chassis or housing 122 that is structured to be mounted in a ceiling, specifically in a space between support structures 118 (FIG. 13), such as ceiling joists (or floor joists of an upper story), and a diffuser assembly 160 that removeably couples to the chassis 122 and is structured to direct an airflow from the evaporator blower 120. The chassis 122 has a top 121, a bottom 123 and a plurality of sides 125. The condensing unit 110 is fluidly and/or electrically coupled to the evaporator blower 120. In an embodiment, the support structures 118 are a minimum12 inches apart from each other and define a structure space 119 between them.

Figure 11:
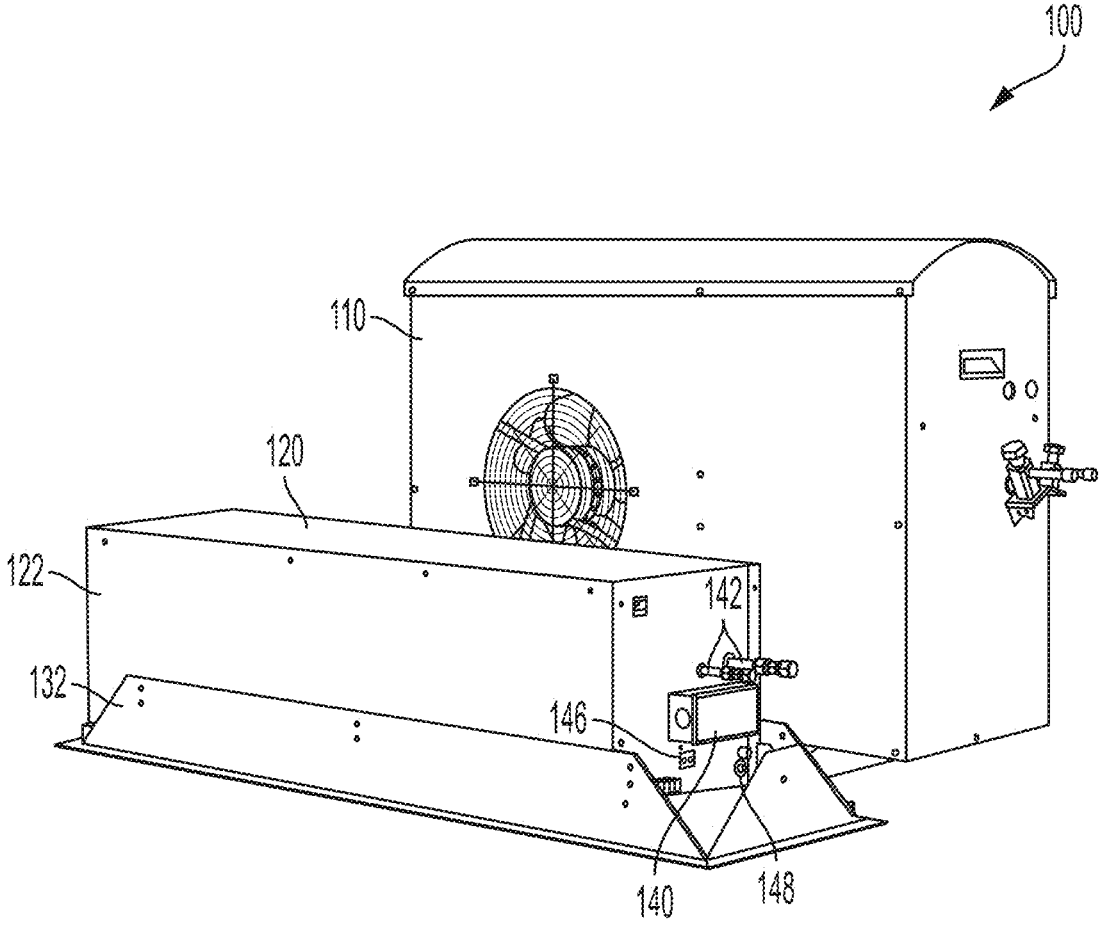
FIG. 11 is a perspective view of another embodiment of a cooling system according to the present invention.
Figure 12:
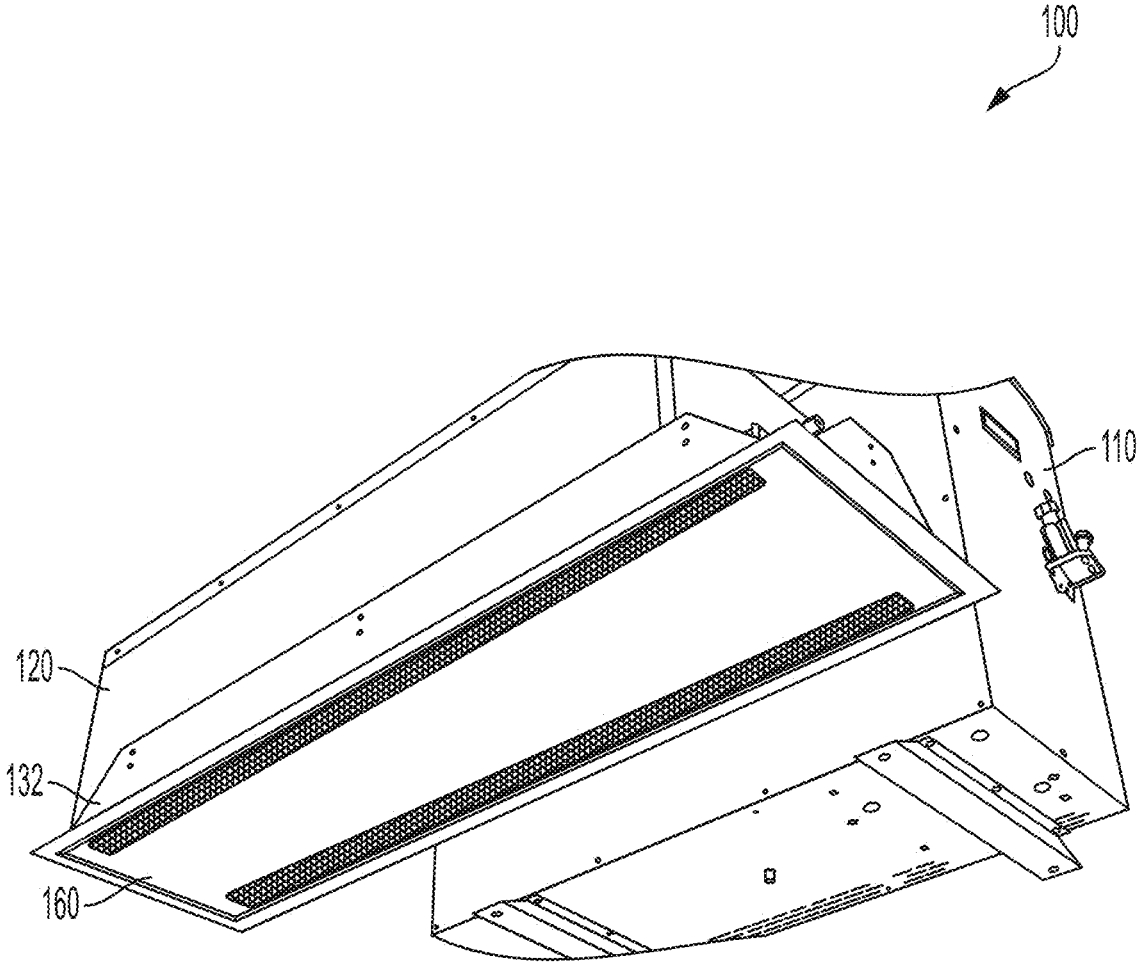
FIG. 12 is another perspective view of the embodiment of FIG. 11.
Figure 14:
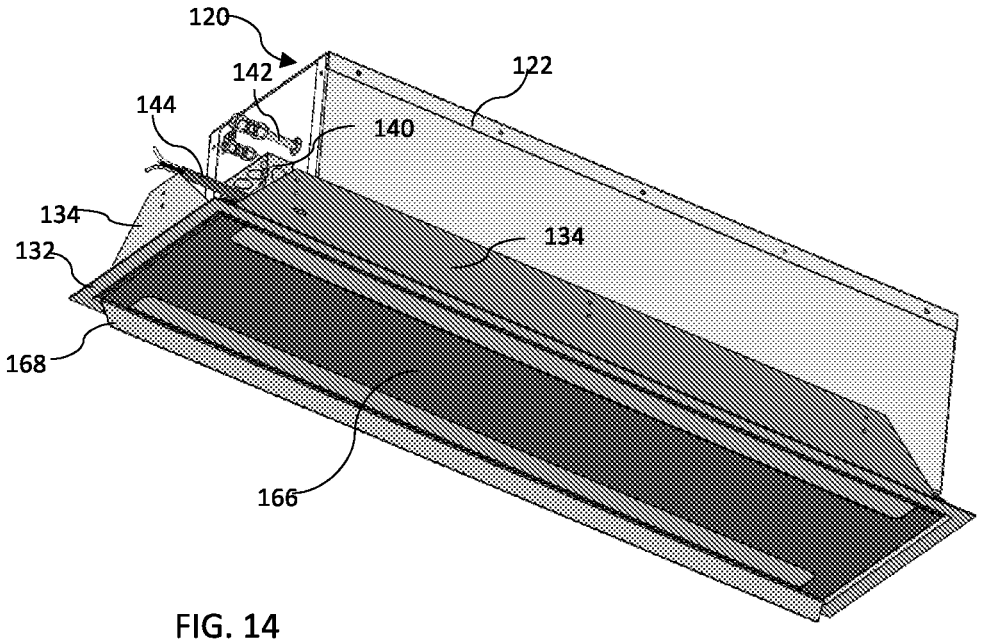
FIG. 14 is a perspective view of an embodiment of an evaporator blower according to the present invention.
Figure 19:
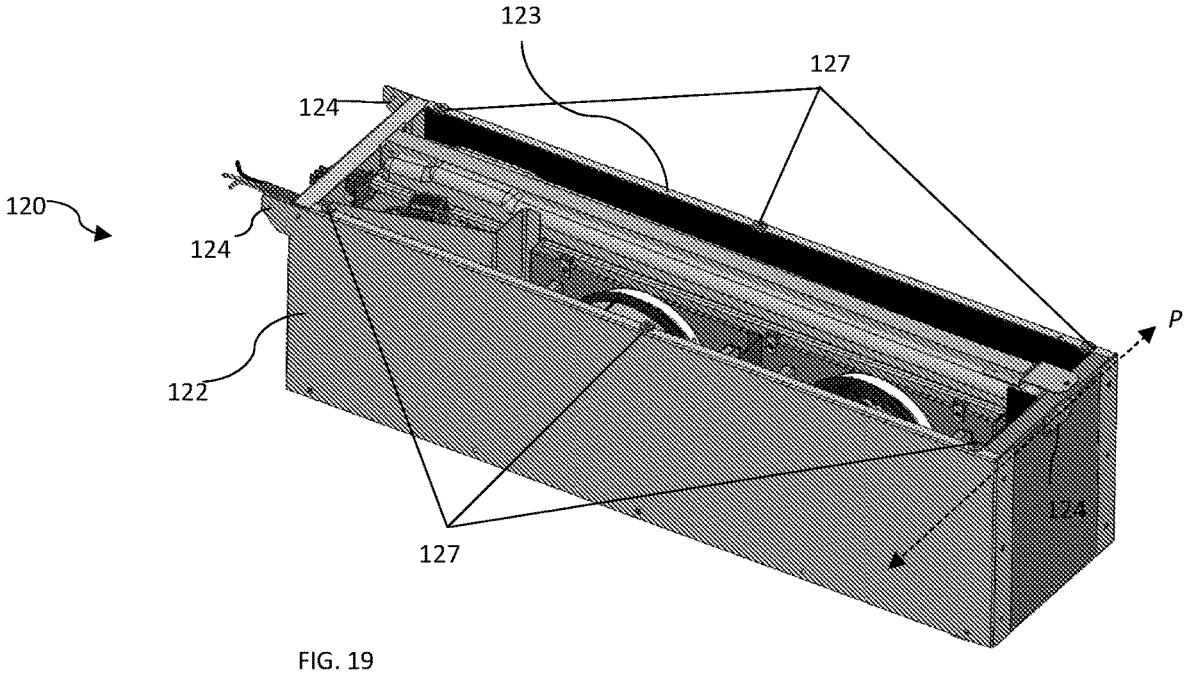
FIG. 19 is a perspective view of an embodiment of a chassis of the evaporator blower according to the present invention.
Figure 20:
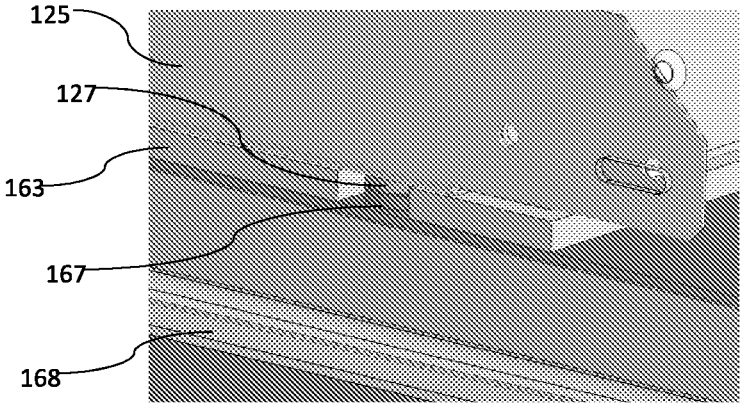
FIG. 20 illustrates a close-up view of a portion of a diffuser and a chassis according to the present invention.

As seen in FIGS. 11 and 14, chassis 122 further includes at least one junction box 140 for electrically coupling to the power supply (not shown), refrigerant piping 142 (such as standard suction line and liquid line) for coupling to condensing unit 110, a 24-volt connection 144, a remote sensor cable connection 146, and a drain 148. As shown in FIG. 19, the chassis 122 includes one or more coupling elements 124 structured to couple the chassis to a flange 130 and/or the support structures 118.

Figure 13:
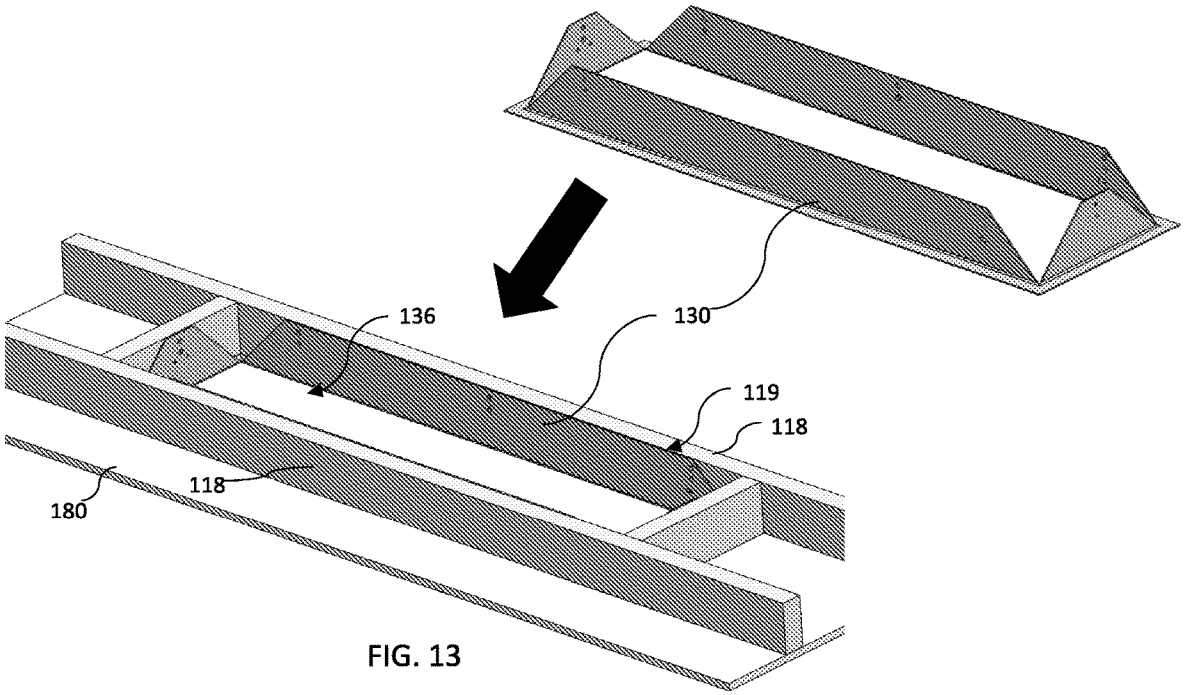
FIG. 13 is a perspective view of an embodiment of a flange according to the present invention being installed into a ceiling space.
Figure 15:
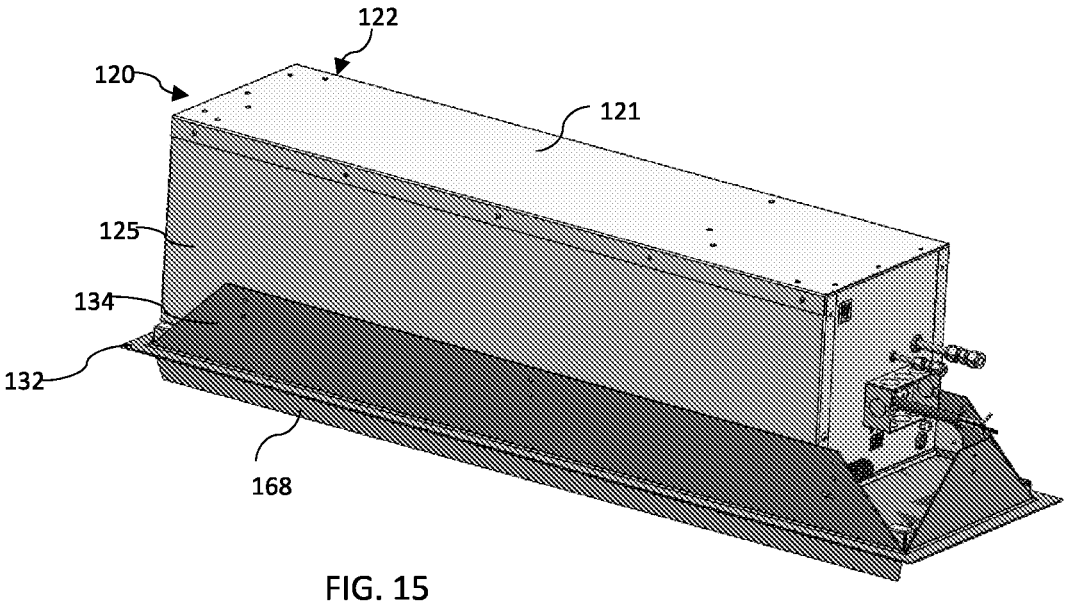
FIG. 15 is another perspective view of the embodiment of FIG. 14.
Figure 16:
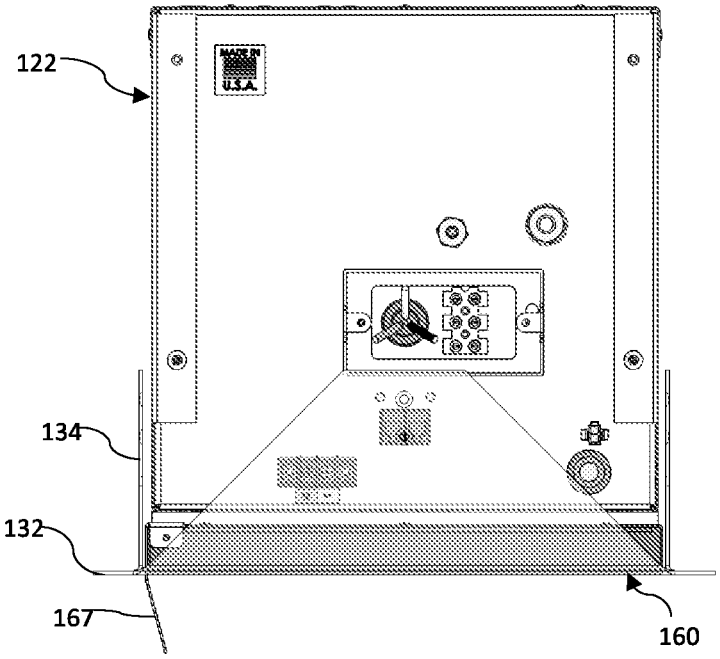
FIG. 16 is a side elevational view of an embodiment of the evaporator blower according to the present invention.
Figure 17:
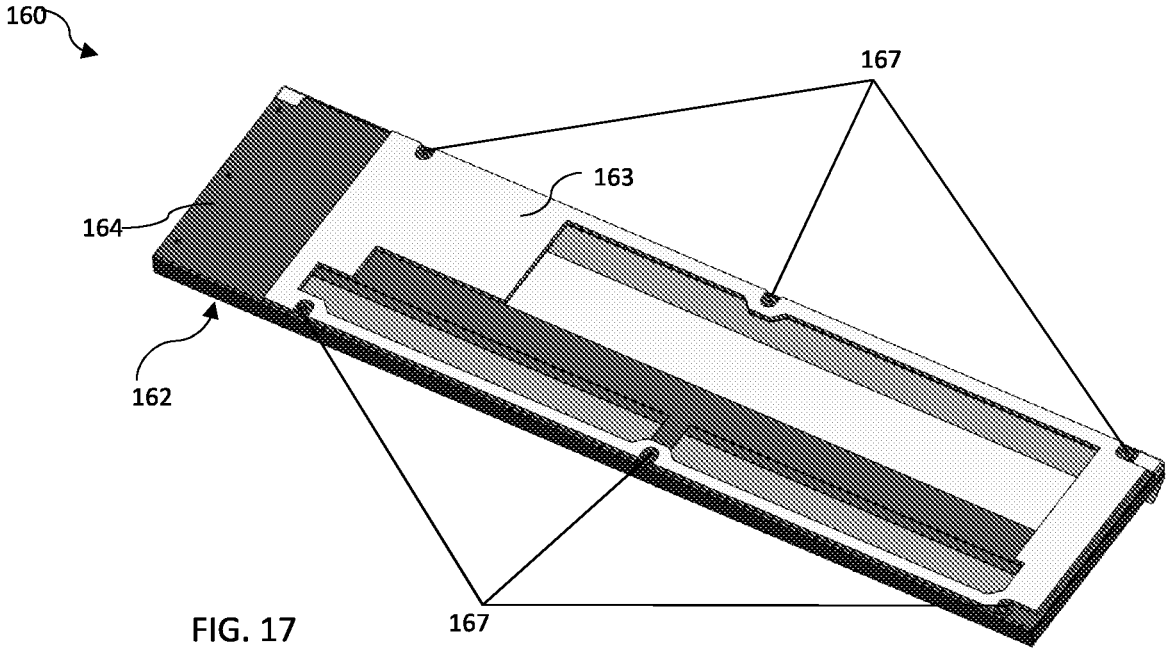
FIG. 17 is a perspective view of an embodiment of a diffuser assembly according to the present invention.

Similar to previously discussed embodiments and referring to FIGS. 13-15, the chassis 122 extends above a ceiling surface 180 when installed or at least partially into the structure space 119. The mounting flange 130 ("flange") is configured to secure evaporator blower 120 to the support structures 118. In an embodiment, the mounting flange 130 is configured to be inserted into the structure space 119 and couple to the support structures 118 (e.g., joists) on a plurality of sides using a plurality of fasteners. As shown, the flange 130 includes a planar lip 132 and a plurality of sides 134 that extend from the planar lip 132. The planar lip 132 is configured to abut the ceiling surface 180 upon installation. Once installed, the planar lip 132 and the plurality of sides 134 define a flange opening 136 dimensioned to accept the chassis 122. The various components housed in the chassis 122, such as fans, evaporator coils, intake and outlets, are the same or similar to components discussed in previous embodiments unless otherwise stipulated. The one or more coupling elements 124 of the chassis 122 enable the chassis 122 to pivot about a pivot axis P relative to the flange 130 such that the chassis 122 can be tipped downward from the flange opening 136 for installation/maintenance purposes and alternatively tipped back up into the flange opening 136 and locked into place.

Figure 18:
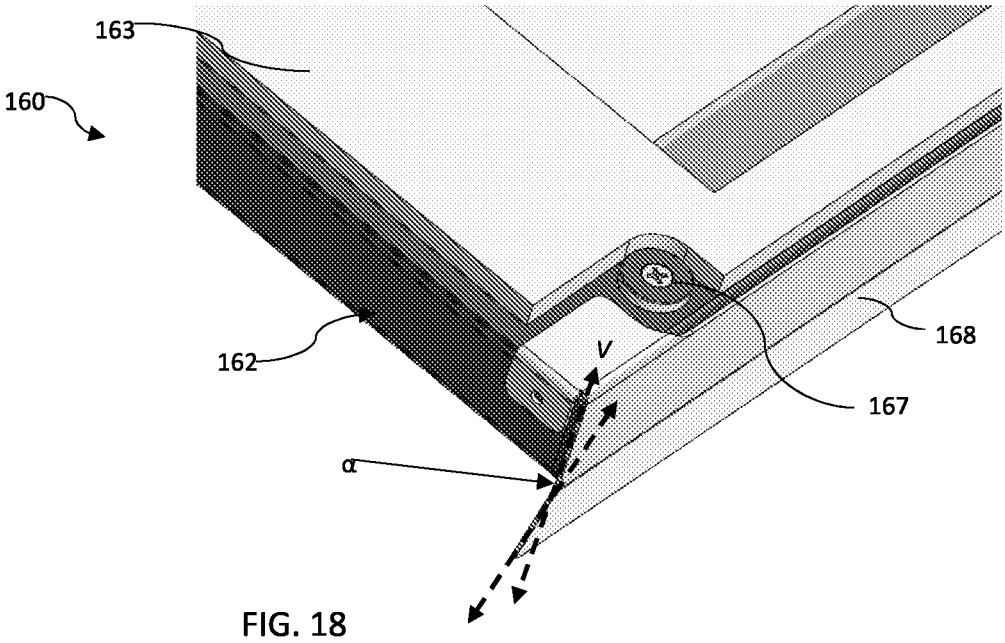
FIG. 18 is a close-up view of the embodiment of FIG. 17.

In the embodiment shown in FIGS. 14-18, the diffuser assembly 160 is removably coupled to the chassis 122. The diffuser assembly 160 includes a diffuser housing 162 having a chassis interface 164 that is structured to abut or face the chassis 122 and an outlet surface 166 that enables passage of cooled air from the chassis 122 into an environment. One or more diverting elements 168 are positioned between the diffuser housing 162 and the flange 130. When installed in a small space at least partially surrounded by glass walls (e.g., a wine cabinet), the one or more diverting elements 168 act to inhibit the formation of condensation on the walls of the display case. For example, the one or more diverting elements 168 act to partially direct air flow exiting the diffuser 160. As shown in FIG. 18, the one or more diverting elements 168 are or include a portion that is angularly positioned (a) to the vertical axis V when the diffuser assembly in installed. The one or move diverting elements direct peripheral airflow towards the center of the outlet 166 to inhibit the formation of condensation on wall surfaces proximate to the outlet 166.

The diffuser assembly 160 further includes an interface seal 163 that at least partially covers the chassis interface 164 and acts to form a seal between the chassis 122 and the diffuser assembly 160. The interface seal 163 may also act as an insulating member between the chassis 122 and the diffuser assembly 160. The seal 163 further inhibits cool air from escaping into the environment as it moves from the chassis 122 to the diffuser assembly 160. The diffuser housing 162 includes one or more positioning guides 167 that that are configured to properly position the diffuser assembly 160 relative to the chassis 122 and removably couple the diffuser assembly 160 to the chassis 122. The one or more positioning guides 167 may interact with complementary positioning guides 127 that are positioned on the chassis 122 or formed as part of the chassis 122. The interaction between the one or more positioning guides 167 of the diffuser assembly 160 and corresponding complementary positioning guides 127 on the chassis 122 enable fast coupling of the diffuser assembly 160 to the chassis 122 without the use of tools. Moreover it enables proper positioning of the diffuser assembly 160 relative to the chassis 122. Proper positioning of the diffuser assembly 160 relative to the chassis 122 is important to ensure optimal air flow passage between the chassis 122 and the diffuser assembly 160 and then into the surrounding environment. Proper positioning of the diffuser assembly 160 relative to the chassis 122 also ensures proper positioning of the interface seal 163. Such toolless installation of the diffuser assembly 160 is especially important when installing or performing maintenance on the disclosed air cooling system 100 in a tight space. The toolless installation of the diffuser assembly 160 onto the chassis 122 is accomplished without the use of tools, such as a screw driver or a hammer.

In an embodiment, the positioning guides 167 are magnetic bodies that are coupled to the diffuser housing 162 and the complementary positioning guides 127 on the chassis 122 are magnetic bodies. The magnetic bodies of the diffuser housing 162 have a first polarity and the magnetic bodies on the chassis 122 have a second polarity that is different than the first polarity and attracts magnetic bodies of the first polarity.

One or more components of the embodiments of the air cooling system 100 may be comprised of one or more types of metal, such as steel, zinc, or aluminum, or one or more types of plastic. In an embodiment, one or more components of the air cooling system 100 may be comprised of a combination of metallic and plastic components. One or more components of the embodiments of the air cooling system 100 may be comprised of different sizes, thicknesses and shapes while still keeping with the spirit, function, and intent of each device.

While the present invention has been particularly shown and described with reference to certain exemplary embodiments, it will be understood by one skilled in the art that various changes in detail may be effected therein without departing from the spirit and scope of the invention that can be supported by the written description and drawings. Further, where exemplary embodiments are described with reference to a certain number of elements, it will be understood that the exemplary embodiments can be practiced utilizing either less than or more than the certain number of elements.

What is claimed is:

1. An air cooling system, comprising:

a chassis dimensioned to fit between a pair of joists;

a mounting flange configured to pivotally couple to the chassis;

an evaporator positioned in the chassis and configured to cool air flowing through the chassis; and a diffuser assembly comprising a plurality of positioning guides configured to toolessly couple the diffuser assembly to the chassis, wherein the diffuser assembly is configured to enable passage of the cool air from the chassis though the diffuser assembly and to a diffuser outlet, wherein, when the chassis is fitted between the pair of joists, the chassis is configured to pivot relative to the mounting flange between a first position where the chassis is angled at least partially below the mounting flange, and a second position where the chassis is horizontally aligned with the mounting flange.

2. The system of claim 1, wherein the diffuser assembly further comprises a seal configured to abut a portion of the chassis when the diffuser assembly is toolessly coupled to the chassis, wherein the seal is configured to inhibit the cool air from escaping into a surrounding environment as the cool air moves from the chassis to the diffuser assembly.

3. The system of claim 1, wherein the diffuser assembly further comprises one or more diverting elements configured to extend below the diffuser outlet and positioned at an angular position relative to a vertical axis.

4. The system of claim 1, wherein the mounting flange defines a central opening through which the chassis can pivot between the first position and the second position.

5. The system of claim 4, wherein the mounting flange includes a planar portion extending from the central opening.

6. The system of claim 5, wherein the planar portion of the mounting flange is dimensioned to be secured to the pair of joists.

7. The system of claim 5, wherein the mounting flange includes a plurality of sides that extend from the planar portion.

8. The system of claim 4, wherein the central opening of the mounting flange is rectangular.

9. The system of claim 1, wherein the chassis is configured to house a supply air section, a condenser, a fan assembly, and a return air section.

10. The system of claim 1, wherein the diffuser assembly includes a return air grille in communication with a return air section of the chassis and a supply air grille in communication with a supply air section of the chassis.

11. The system of claim 1, wherein the chassis includes one or more coupling elements configured to enable the pivotal coupling of the chassis to the mounting flange.

12. The system of claim 11, wherein the chassis includes at least one lock element configured to lock the chassis in place relative to the mounting flange.

13. The system of claim 1, further comprising one or more diverting elements configured to direct peripheral air flow direct peripheral air flow towards a center of the outlet to inhibit formation of condensation on surfaces proximate to the outlet.

14. The system of claim 1, wherein the plurality of positioning guides are configured to toolessly uncouple the diffuser assembly to the chassis.

15. The system of claim 1, wherein the plurality of positioning guides are magnetic.

16. An air cooling system, comprising:

a chassis dimensioned to fit between two joists;

an evaporator positioned in the chassis and configured to cool air flowing through the chassis; and a diffuser assembly comprising, an outlet configured to enable passage of cool air from the chassis though the diffuser assembly and to a diffuser outlet;

a plurality of positioning guides configured to toolessly couple and uncouple the diffuser assembly to the chassis; and one or more diverting elements extending from the outlet and configured to inhibit formation of condensation caused by the cool air exiting the outlet.

17. The system of claim 16, wherein the plurality of positioning guides are magnetic.

18. The system of claim 16, further comprising a mounting flange configured to pivotally couple to the chassis, wherein, when the chassis is fitted between the two joists, the chassis is configured to pivot relative to the mounting flange between a first position where the chassis is angled at least partially below the mounting flange, and a second position where the chassis is horizontally aligned with the mounting flange.

19. The system of claim 18, wherein the mounting flange:

defines a central opening and includes a planar portion extending from the central open- ing; and a plurality of sides that extend from the planar portion, wherein at least one of the planar portion and the plurality of sides are configured to be secured between the two joists.

* * * * *